United States Patent [19]

Haven et al.

[11] 4,284,661

[45] Aug. 18, 1981

[54] PROCESS FOR MAKING BISTABLE STORAGE CATHODE RAY TUBE

[75] Inventors: Duane A. Haven, Portland; Robert L. Arneson, Beaverton, both of Oreg.

[73] Assignee: Tektronix, Inc., Beaverton, Oreg.

[21] Appl. No.: 8,293

[22] Filed: Jan. 31, 1979

Related U.S. Application Data

[62] Division of Ser. No. 710,496, Aug. 2, 1976, Pat. No. 4,159,439.

[51] Int. Cl.[2] ..... H01J 31/08; H01J 29/10

[52] U.S. Cl. ..... 427/64; 204/181 R; 204/181 N; 313/398; 427/157; 427/71

[58] Field of Search ..... 313/398; 427/64, 157, 427/71; 204/181 R, 181 N

[56] References Cited

U.S. PATENT DOCUMENTS

| | | | |
|---|---|---|---|
| 3,293,473 | 12/1966 | Anderson | 313/398 |
| 3,531,675 | 9/1970 | Frankland | 313/398 |
| 3,594,607 | 7/1971 | Frankland | 313/398 |
| 3,710,173 | 1/1973 | Hutchins et al. | 313/398 |
| 3,956,662 | 5/1976 | McTeague et al. | 313/398 |
| 3,978,366 | 8/1976 | Steele | 313/398 |
| 3,982,150 | 9/1976 | Mossman | 427/64 |
| 4,110,659 | 8/1978 | Mason et al. | 313/398 |
| 4,159,439 | 6/1979 | Haven et al. | 313/398 |

*Primary Examiner*—John D. Smith

[57] ABSTRACT

A method for making a storage target for use with a cathode ray tube involves forming an insulating material at least around each of an array of collector electrode members which has been formed onto a conductive layer but leaving outer ends of the collector electrode members exposed and fixing a layer of dielectric storage material onto the conductive layer and in engagement with the insulating material around the collector electrode members to prevent luminance around the collector electrode members.

4 Claims, 10 Drawing Figures

PROCESS FOR MAKING BISTABLE STORAGE CATHODE RAY TUBE

This is a division of application Ser. No. 710,496, filed Aug. 2, 1976, now U.S. Pat. No. 4,159,439.

BACKGROUND OF THE INVENTION

U.S. Pat. Nos. 3,531,675 and 3,956,662, which are assigned to the present assignee, disclose bistable storage targets of storage cathode ray tubes wherein the storage target has a multiplicity of collector electrode members extending through a layer of storage dielectric material which is in intimate engagement with the collector electrode members and collector or target electrode thereunder. Similar target structures are also disclosed in U.S. Pat. No. 3,978,366 and U.S. patent application Ser. No. 700,278, filed June 28, 1976, both are assigned to the present assignee. Since the dielectric storage layer in these storage targets is in direct contact with the collector electrode members, background luminance during operation of the cathode ray tube takes place around the collector electrode members because collection efficiency of flood gun primary electrons at the interface of the storage dielectric and the exposed collector electrode members is high due to the large area of the collector electrode members being exposed which increases the current density thereat. This background luminance is undesirable since it results in impaired performance as it decreases contrast and presentation of the information is not precise which hinders viewability of the displayed information on the storage target as well as reading out the displayed information therefrom.

SUMMARY OF THE INVENTION

The present invention relates to cathode ray tubes and more particularly to bistable storage targets therefor.

In accordance with the present invention, a cathode ray storage tube includes a storage target comprising an insulating support member having a conductive coating provided on an inner surface thereof. A pattern of collector electrode members extends outwardly from the conductive coating and at least each of the collector electrode members has an insulating coating therearound except for an exposed area at the outer ends of the collector electrode members. A dielectric storage layer is located on the storage target with the dielectric storage layer engaging or surrounding the insulated collector electrode members and sections of the insulated collector electrode members including the exposed areas thereof extending beyond the surface of the dielectric storage layer.

An object of the present invention is to provide a cathode ray tube having a storage target that provides low background luminance to enhance viewing readout of information thereon.

Another object of the present invention is the provision of a cathode ray tube having a storage target provided with conductive collector electrode members extending through a dielectric storage layer which are part of an undercollector electrode under the dielectric storage layer and which are covered with insulating material to insulate the collector electrode members from the dielectric storage layer.

A further object of the present invention is to provide a storage target for a cathode ray tube that has insulated collector electrode members extending through a storage dielectric layer with the outer ends of the insulated collector electrode members being exposed to collect secondary electrons from written areas of the storage dielectric layer.

An additional object of the present invention is the provision of a storage target for a storage cathode ray tube having a coating of insulating material between the layer of storage dielectric material and conductive collector electrode members to minimize the background luminance at the collector electrode member locations during the display of information and which improves the viewing and readout of such displayed information.

BRIEF DESCRIPTION OF THE DRAWINGS

Other objects and advantages of the present invention will be apparent from the following detailed description of preferred embodiments thereof and the attached drawings of which.

DETAILED DESCRIPTION OF THE INVENTION

Figure 1:
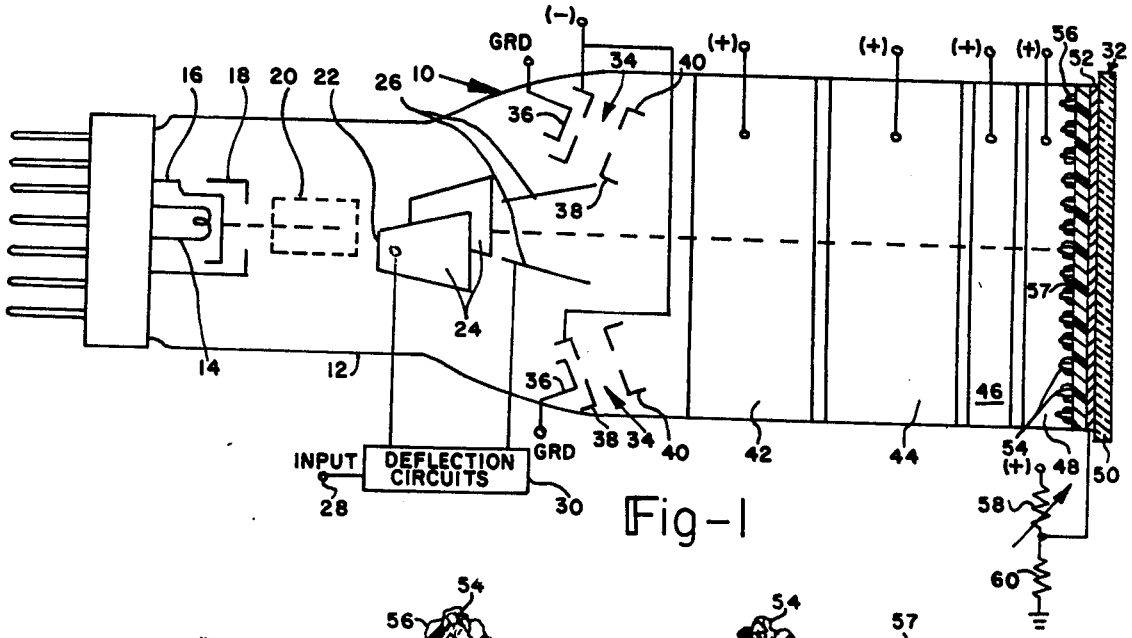
FIG. 1 is a schematic representation of a cathode ray storage tube according to the present invention.

Referring to FIG. 1, a cathode ray storage tube 10 includes an envelope 12 formed of insulating material which houses an electron gun including a filament 14, a cathode 16 for connection to a high negative voltage source, a control grid 18 and a focusing and accelerating structure 20. Electron beam 22 of high velocity electrons produced by the electron gun is deflected horizontally via horizontal deflection plates 24 and vertically by vertical deflection plates 26 in accordance with an input signal applied to input terminal 28 which operates conventional deflection circuits 30 connected to the horizontal and vertical deflection plates so that the electron beam is selectively positioned along storage target 32 at the end of envelope 12 opposite the electron gun in correspondence with the input signal.

One or more flood electron guns 34 is provided in the storage tube, each flood gun including a cathode 36, a control grid 38 and an anode 40. Flood guns 34 are supported inside envelope 12 adjacent output ends of vertical deflection plates 26. Cathodes 36 are conventionally operated at a low voltage level which is typically ground level, whereas grids 38 are connected to a low negative voltage. Low velocity electrons emitted from flood guns 34 diverge into a conically-shaped beam and they are uniformly distributed over target 32.

A plurality of electrodes are disposed on the inner surface of envelope 12 between flood guns 34 and target 32. These electrodes are preferably provided as spaced coatings of conductive material and the first coating 42 functions primarily as a focusing electrode for the flood electrons emitted from the flood guns; it is connected to a suitable source of positive electrical potential. A second electrode wall coating 44 is spaced from coating 42; it is also electrically connected to a positive potential and functions as a focusing and collimating electrode. A third coating electrode 46 is spaced from coating 44, is connected to a positive potential and functions too as a focusing and collimating electrode. As a result of the collimating action of the electrode wall coatings, the electrons from the flood guns 34 are uniformly distributed over the surface of target 32.

A fourth electrode wall coating 48 is disposed between and spaced from wall coating 46 and storage target 32 and it is connected to positive voltage. Wall coating 48 also functions as a focusing and collimating electrode for the flood electrons.

Electrodes 42, 44, 46 and 48 are connected to descending positive potentials with the highest positive potential being connected to electrode 42 for optimum operation.

Figure 2:
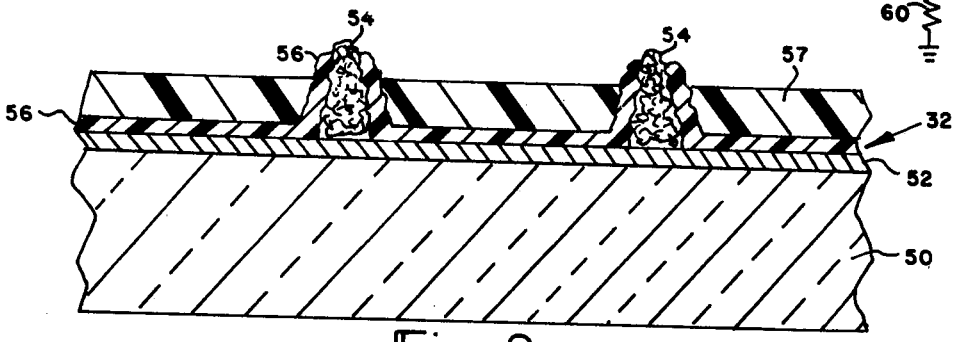
FIG. 2 is an enlarged cross section of part of the bistable storage target of the cathode ray storage tube of FIG. 1.

Storage target 32 comprises insulative end plate 50 having a transparent target or collector electrode 52 over which is disposed a series of conductive collector electrode members 54 in the form of a dot pattern and an insulating layer 56 that covers collector electrode 52 and surrounds collector electrode members 54 except for the outer exposed ends thereof as shown in FIG. 2. A layer of dielectric material 57 covers insulating layer 56 except for the locations where the insulated collector electrode members 54 extend therethrough and beyond the outer surface of layer 57. The insulative end plate 50 defines a support member and is made of transparent material, e.g. glass. Target or collector electrode 52 is a thin transparent coating of preferably tin oxide which is suitably connected to the midpoint of a voltage divider which includes resistors 58 and 60 connected between a positive potential and ground. Resistor 58 is variable and is adjusted so that a proper operating voltage is applied to target electrode 52. Alternatively, target electrode 52 may be connected to amplifying means for providing an electrical readout of information stored on the storage target which can then be displayed in raster fashion as disclosed in U.S. Pat. No. 3,214,516 or hard copies of the stored information can be made as disclosed in U.S. Pat. No. 3,811,007.

Collector electrode members 54 are conductive particles, preferably of cobalt, and have a preferably substantially conical configuration which have their bases connected to electrode 52 and apices extending outwardly from the outer surface of dielectric layer 57. Collector electrode members 54 can be configurations other than conical, e.g. pyramidal, triangular, etc. Insulating layer 56 is preferably aluminum oxide or thorium oxide or any suitable oxide that can be electrophoretically deposited onto electrode 52 and electrode members 54. Dielectric layer 57 is phosphor and preferably P-1 type phosphor or it can be an admixture of P1 phosphor and yttrium oxide or yttrium oxysulfide or yttrium oxide or yttrium oxysulfide activated by a rare earth element as disclosed in U.S. Pat. No. 4,110,659.

Information is written on storage target 32 via electron beam 22, and it may be in the form of a waveform applied to vertical deflection plates 26 while the beam is scanned horizontally via horizontal deflection plates 24. In addition to electrical readout, the information written on the storage target is visibly displayed through transparent support member 50. During operation, the tube potentials are adjusted such that beam 22 has a relatively high velocity for writing and is capable of producing secondary electrons when it strikes storage dielectric 57. The area engaged by beam 22 is raised to the potential of collector electrode members 54 and target electrode 52 from ground level thus causing the dielectric target to phosphoresce thereat. These secondary electrons are then collected by the exposed areas of collector electrode members 54, and the areas of storage dielectric engaged by beam 22 are positively charged so that flood electrons from flood guns 34 are attracted to these positively-charged areas; they emit secondary electrons at a ratio of one therefrom, the secondary electrons being collected via collector electrode members 54 adjacent the positively charged (written) areas of storage dielectric 57 thereby causing the information to be visually observed and to remain indefinitely for purposes of study or being photographed. The target can be erased in a conventional manner by pulsing the target electrode to raise the storage dielectric to the potential of the collector electrode member and then lowering it to ground level so that the flood electrons maintain it thereat until beam 22 writes information thereon again. Reference is made to U.S. Pat. Nos. 3,293,473 and 3,531,675 for further information concerning the operation of bistable storage targets of this type.

Figure 4:
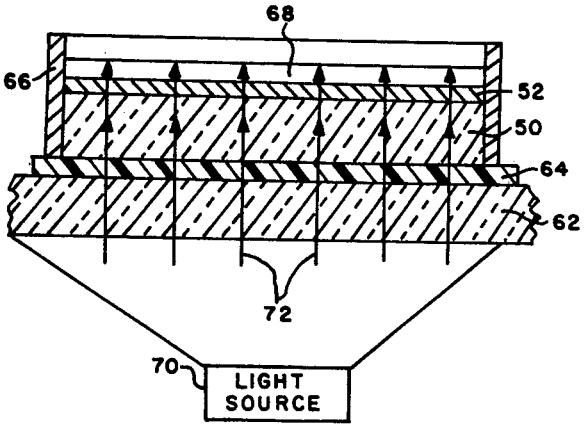
FIG. 4 is a cross-sectional view illustrating the fabrication of a pattern of collector electrode members on a conductive layer of a support member.

Attention is directed to FIGS. 4–7 for a description of the fabrication of the storage target 32. As shown in FIG. 4, a transparent member 62 has a photomask 64, which has a hole pattern, disposed thereon. Transparent support member 50 with transparent conductive layer 52 thereon is positioned on photomask 64. A frame 66 is disposed along the periphery of support member 50 and a photopolymerizable slurry 68 of the polyvinyl alcohol, water, ammonium dichromate, cobalt powder having particle size of 2–5 microns and isopropyl alcohol is poured onto conductive layer 52.

Any fine conductive particles or particles that are made conductive other than cobalt can be used, but the particles that are darker with reduced reflective characteristics are more desirable for trace to background contrast. In the case of cobalt, it is black and provides optimum operational characteristics. The particles may also be of the same material as the conductive layer.

Collimated light source 70 is utilized to transmit light rays 72 through transparent member 62, the holes in photomask 64, support member 50, transparent conductive layer 52 and into slurry 68 so that the areas of slurry 68 the light rays 72 from light source 70 engage cause activation of the polyvinyl alcohol in these areas by polymerizing same.

The frame 66 is removed and the target structure is washed with water which removes the non-activated slurry and leaves behind a pattern of cobalt dots.

Figure 3:
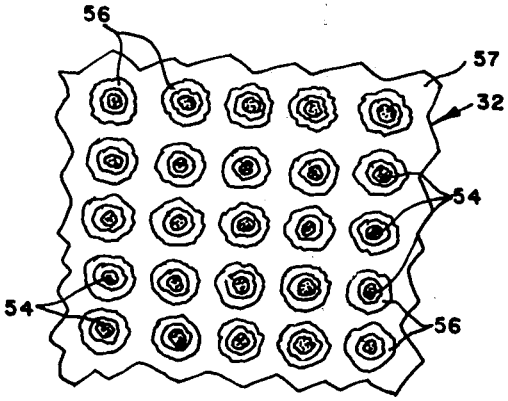
FIG. 3 is a part forward view of the storage target that faces the electron beam means.
Figure 5:
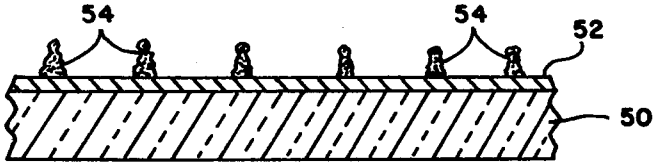
FIG. 5 is a cross-sectional view of the pattern of collector electrode members on the conductive layer of the support member.

A shrinking agent can be applied to the target structure such as acetone, aqueous ammonium sulfate, alcohols or other hydrophyllic agents and this shrinking agent shrinks the cobalt particles into a denser mass by rapid extraction of $H_2O$ thereby providing cobalt dots 54 defining a distinct dot pattern on conductive layer 52 as illustrated in FIGS. 3 and 5. The target structure is then dried.

The target structure of FIG. 5 is next mounted on a metal frame 74 which is in electrical engagement with conductive layer 52 and which is connected to a negative terminal of a 100 V. to 500 V. of a constant voltage DC source of supply with 250 V. being the desired voltage that is used. This assembly is placed in tank 76 opposite a counterpoise electrode 78 which is connected to the positive terminal of the DC voltage. Counterpoise electrode 78 establishes a uniform electric field between frame 74 and conductive layer 52 with collector electrode member 54 thereon to provide electrophoretic action.

Figure 7:
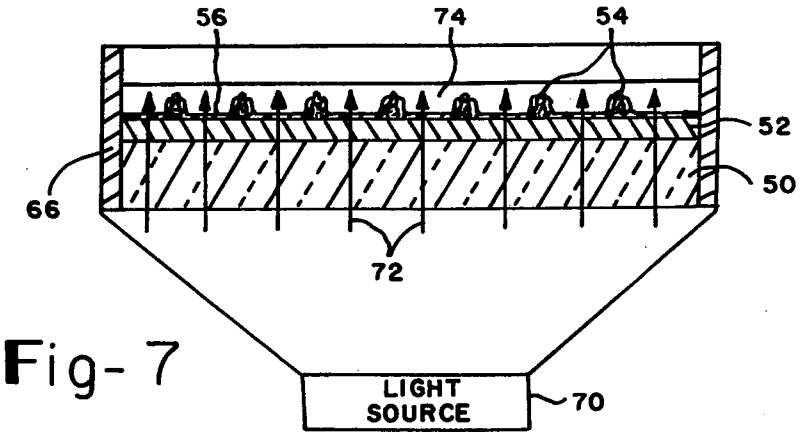
FIG. 7 is a cross-sectional view of the fabrication of the dielectric storage layer.
Figure 6:
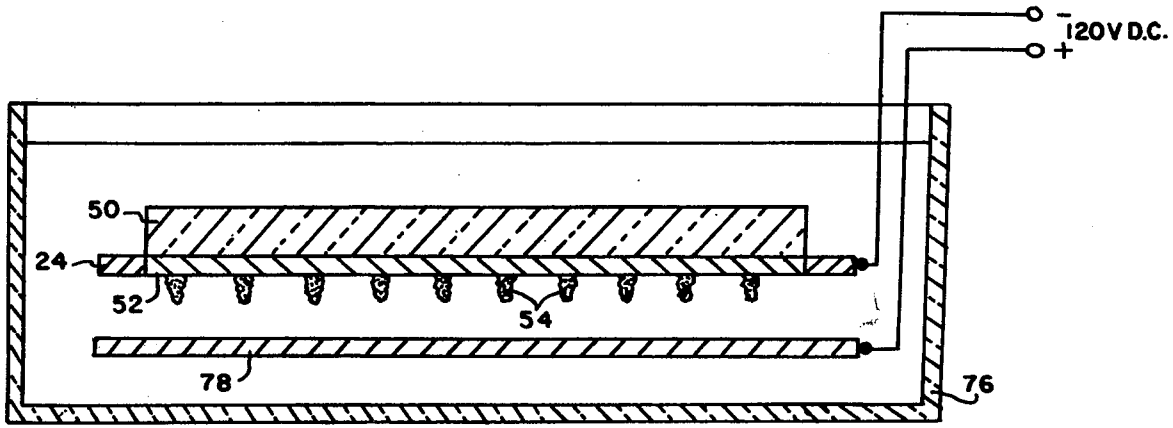
FIG. 6 is a cross-sectional view of a tank for the electrophoretic deposition of insulating material onto the conductive layer and the area of the collector electrode member except the outer ends thereof.

A suspension of colloidal insulating material such as aluminum oxide or thorium oxide in isopropyl alcohol, water and an electrolyte of aluminum nitrate in the case of aluminum oxide or thorium nitrate when using thorium oxide. Upon an electric field being established when the DC voltage is applied to frame 74, conductive layer 52 and electrode 78 within the colloidal suspension, insulating particles of aluminum oxide or thorium oxide will be attracted to and plated onto frame 74, conductive layer 52 and collector electrode members 54 in accordance with electrophresis thereby providing a continuous insulating coating or layer 56 thereover as shown in FIGS. 2 and 7 which has a preferable thickness of 2–5 microns. Use of aluminum oxide is preferred because it provides increased secondary electron emission characteristics which results in increased writing speed of the storage target.

The target assembly of support member 50, conductive layer 52 with collector electrode members 54 thereon and insulating layer 52 thereover is removed from tank 76. It is cleaned by application of a solvent, preferably isopropyl alcohol, and a negative working photoresist material, such as KTFR made by Eastman Kodak Company, is deposited onto insulating layer 56. Light is passed through support member 50, conductive layer 52 and insulating layer 56 which polymerizes the photoresist except the outer areas of the insulating layer 56 covering collector electrode members 54. Nonpolymerized photoresist at the outer areas of insulating layer 56 is removed by a suitable solvent such as, for example, xylene. These outer areas of insulating layer 56 are etched away via alkaline etchant such as sodium hydroxide followed by an application of nitric acid thereby exposing outer areas of collector electrode member 54. The target structure is washed by water and then baked in an oven to remove the polymerized photoresist. The target assembly in this form is now ready for receiving the layer of storage dielectric material.

An alternative way to expose outer areas or sections of collector electrode members 54 would be to deposit a positive-working photoresist material, such as that made by the Shipley Company and identified as AZ-1350J, over conductive layer 52 and collector electrode members 54. Light is then passed through support member 50 and conductive layer 52 which depolymerizes the photoresist except at the outer areas of collector electrode members 54 due to these electrode members acting as a photomask. The depolymerized photoresist is removed by a conventional aqueous solvent such as AZ Developer made by the Shipley Company. A layer of insulating material 56 is electrophoretically deposited onto conductive layer 52 and the exposed areas of collector electrode members 54 as hereinabove disclosed relative to FIG. 6, whereafter cleaning the target assembly, the photoresist covering outer areas of collector electrode members 54 is removed via baking at a suitable temperature thereby exposing outer areas of these electrode members.

An insulating layer can be applied onto the target structure disclosed in U.S. Pat. No. 3,978,366 before the dielectric storage layer is applied in the manner disclosed hereinabove.

Figure 8:
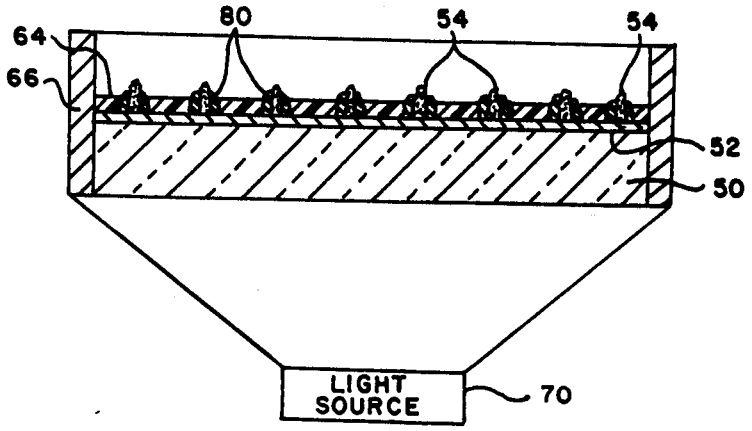
FIG. 8 is a cross-sectional view of the fabrication of insulating collars around the collector electrode members.

As shown in FIG. 8 each of collector electrode members 54 can be surrounded by a collar of insulating material rather than completely covering conductive layer 52 and part of electrode members 54 as hereinabove described. A photomask 64 is placed onto conductive layer 52. Frame 66 is placed around the support member 50 and conductive layer 52 and a slurry identical to slurry 68 is introduced onto the photomask. Light is passed through support member 50 and conductive layer 52 and into the slurry through the holes in the photomask thereby activating the slurry by polymerizing the slurry where the light engages it. The non-activated slurry on the photomask where no holes are located is washed leaving behind the photomask and the pattern of collector electrode members 54 of metallic particles. Acetone is applied onto the target structure to shrink the metallic particles of each collector electrode member 54 into a denser mass. Drying of this target structure is then undertaken.

A slurry of insulating material, which is preferably deactivated yttrium oxide or deactivated yttrium oxysulfide in polyvinyl alcohol, is introduced onto the photomask and into the holes thereof around the shrunken collector electrode members to a depth so that the outer ends of the collector electrode members are suitably exposed. Light from light source 70 is then shone through support member 50, conductive layer 52 and into the slurry around the collector electrode members 54 causing polymerization thereof.

The non-polymerized slurry is washed away by water and the photomask is burned off. Thus, the collector electrode members 54 are individually surrounded by collars 80 of insulating material and the outer areas are exposed.

The target structure having insulating layer 56 covering the conductive layer 52 and the collector electrode members 54 except for the outer exposed ends thereof or having insulating collars 80 around each of collector electrode members 54 has a photopolymerizable slurry 74 of polyvinyl alcohol, water, dimethyl sulfoxide, ammonium dichromate and phosphor or the combination of phosphor and yttrium oxide or yttrium oxysulfide material disclosed in U.S. Pat. No. 4,110,659, introduced onto insulating layer 56 or conductive layer 52 as shown in FIG. 4, whereafter collimated light source 70 transmits light rays 72 through support member 50, conductive layer 52, insulating layer 56 and into slurry 74 and the light rays activate slurry 74 in the areas where no collector electrode members are located thereby polymerizing the polyvinyl alcohol in these areas.

As can be discerned, no photomask is needed for this operation because the collector electrode members 54 provide an integral photomask so that in the area of each electrode member, no polymerization of the polyvinyl alcohol will take place.

The structure is washed with water which removes the nonactivated slurry and leaves behind a layer of light activated slurry defining a dielectric layer. While the photopolymerizable material for formulating the pattern of conductive collector electrode members and dielectric layer is in the form of a slurry, it can be in the form of a photopolymerizable dry film. As can be discerned from FIGS. 2 and 8, the area of the storage dielectric layer 57 surrounding each of electrode members 54 engages insulating layer 56 or collars 80 thereby insulating the storage dielectric layer 57 therefrom in order to minimize luminance around the collector electrode members by decreasing the flood gun primary electron collection efficiency at the interface of the storage dielectric layer and the insulating layer 56 or collars 80 so that these electrons are collected only on the exposed areas of electrode members 54. The exposed outer areas of collector electrode members 54 extend above the outer surface of dielectric storage layer 57 about one-fourth the height of the electrode members.

After the storage target structure has been fabricated, it is baked in an oven at a suitable temperature to remove organic binders and leave the dielectric storage layer comprising essentially phosphor material or the material disclosed in the target of U.S. Pat. No. 4,110,659. The storage target is not completed and is assembled in position on envelope 12 in accordance with conventional frit-sealing techniques with the support member defining the faceplate.

The target structure can take the form disclosed in U.S. Patent Application Ser. No. 710,498, filed Aug. 2, 1976 wherein the collector electrode members are of nickel or other suitable metal that have been plated onto laminated metallic coatings of chromium and copper with an insulating layer covering the target electrode and collector electrode members except for the top surfaces thereof and storage dielectric material covering the insulating layer while being isolated from the collector electrode members and target electrode via the insulating layer.

The pattern of collector electrode members 54 representing the collector electrode structure is preferably such that the center-to-center distance between adjacent collector electrode members 54 is less than the diameter of electron beam 22 and this provides improved collector means for collecting secondary electrons, optimum resolution of information that is displayed on the target, elimination of trace shadowing, improved visible display, minimized luminance around the collector electrode members and readout accuracy of the stored information on the bistable storage target. The collection efficiency of secondary electrons by the collector electrode members is increased due to the substantial uniform potential provided by the pattern of collector electrode members. This provides faster writing rate and improved luminance of the target. The life of the storage target is increased because the target operates at a lower operating potential since target degradation is slower at lower operating potentials.

The embodiments hereinbefore described are directed to a planar support member having the thin layer of conductive coating thereon and on which the conductive particles defining the collector electrode members are connected to a conductive layer, an insulating layer covers the conductive coating and the collector electrode members except for the outer exposed sections or covering the collector electrode members except for the outer exposed sections and a layer of dielectric storage material covers the insulating layer and is isolated from the collector electrode members by the insulating layer or covers the conductive layer and is isolated from the collector electrode members by insulation collars around the collector electrode members; and the apices of the exposed collector electrode members extending above the top or outer surface of the dielectric layer thereby defining a storage target of planar construction. The support member can be planar or curved depending on the size of the target to be fabricated.

Figure 9:
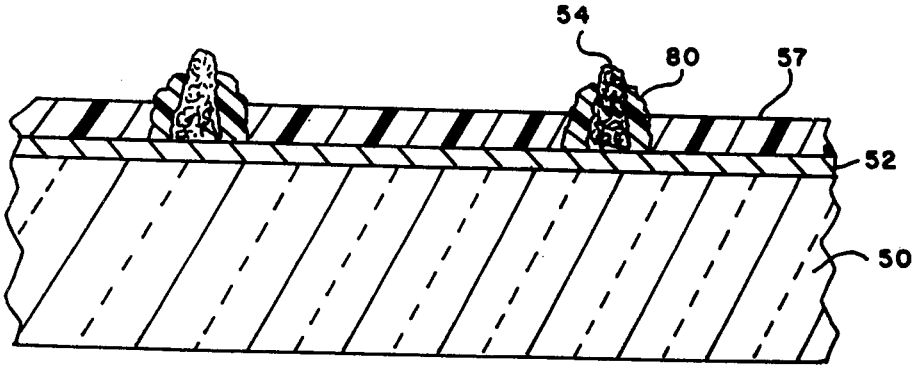
FIG. 9 is an enlarged cross section of part of the bistable storage target fabricated with insulating collars around the collector electrode members.
Figure 10:
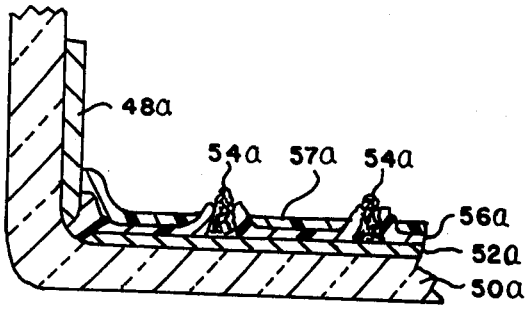
FIG. 10 is a part cross-sectional view of a bistable storage target having a curved insulating support member.

FIG. 10 shows a faceplate or insulating support member **50*a* as being curved of dish-like configuration, and it can be part spherical if desired. Collimating electrode 48*a* can be on the inside surface of the wall and spaced from target or collector electrode 52*a*. Insulating layer 56*a* covers collector electrode 52*a* and all of collector electrode members 54*a* except for the other exposed areas thereof and covers the space between electrodes 52*a* and 48*a* to prevent the periphery of electrode 52*a* or the electrode 48*a* acting as a collector of primary low velocity electrons or secondary electrons that could light up the periphery of the bistable storage target in the manner disclosed in the aforementioned Ser. No. 700,278, filed June 28, 1976. Dielectric storage materal 57*a* covers insulating layer 56*a* and is isolated from collector electrode members 54*a* by insulating layer 56*a* as heretofore described. Insulating collars as shown in FIG. 9 can of course be used in place of insulating layer 56*a* whereby the insulating material forming the insulating collars can cover the outer periphery of electrode 52*a* and the inner end of electrode 48*a*** or the dielectric storage material can cover these areas without any insulating material thereunder.

While preferred embodiments of the present invention have been illustrated and described, it will be apparent that changes and modifications may be made to this invention without departing therefrom in its broad aspects. The appended claims therefore cover all such changes and modifications as fall therewithin.

The invention is claimed in accordance with the following:

1. A method of making a storage target for use with a cathode ray tube comprising the steps of:

applying a conductive layer onto an inside surface of an insulating support member;

forming a pattern of collector electrode members on said conductive layer;

forming an insulating material at least around each of said collector electrode members except for outer exposed areas thereof; and fixing a layer of dielectric storage material along said conductive layer and in engagement with said insulating material around said collector electrode members.

2. A method according to claim 1 wherein said insulating material is deposited over said conductive layer and around each of said collector electrode members except for outer exposed areas thereof.

3. A method according to claim 1 wherein said layer of dielectric storage material is fixed onto said conductive layer and said insulating material around each of said collector electrode members.

4. A method according to claim 1 wherein said insulating material is deposited onto said conductive layer and around each of said collector electrode members, and said layer of dielectric storage material is fixed onto said insulating material and around each of said collector electrode members.

* * * * *

UNITED STATES PATENT AND TRADEMARK OFFICE

CERTIFICATE OF CORRECTION

PATENT NO. : 4,284,661

DATED : August 18, 1981

INVENTOR(S) : DUANE HAVEN and ROBERT ARNESON

It is certified that error appears in the above-identified patent and that said Letters Patent are hereby corrected as shown below:

Column 7, line 26, reads "is not completed" it should read --is now completed--.

Signed and Sealed this

*Third* Day of *November 1981*

[SEAL]

*Attest:*

GERALD J. MOSSINGHOFF

*Attesting Officer*

*Commissioner of Patents and Trademarks*